US005950812A

United States Patent [19]

Tanacan et al.

[11] Patent Number: 5,950,812

[45] Date of Patent: Sep. 14, 1999

[54] ROCKER SWITCH USING A STAR SPRING

[75] Inventors: Mehmet K. Tanacan, Farmingdale, N.Y.; Gregory Lawren, Bonita, Calif.; Ralph Giannuzzi, Annapolis; Michael D. Williams, Morganton, both of Md.; Clifford G. Martin, Newton, N.C.

[73] Assignee: Leviton Manufacturing Co., Inc., Little Neck, N.Y.

[21] Appl. No.: 09/276,943

[22] Filed: Mar. 26, 1999

[51] Int. Cl.[6] ..... H01H 21/00

[52] U.S. Cl. ..... 200/458; 200/6 R; 200/553; 200/339

[58] Field of Search ..... 200/6 R, 16 R, 200/16 C, 16 D, 451, 453, 454, 458–467, 553, 554, 557, 339, 560–562

[56] References Cited

U.S. PATENT DOCUMENTS 3,770,920 11/1973 Poliak ..... 20/67 A
4,472,614 9/1984 Newland ..... 200/153 M
4,777,333 10/1988 Valenzona ..... 200/68.1
4,843,200 6/1989 Parlatore et al. ..... 200/553
5,836,443 11/1998 Gernhardt et al. ..... 200/557

*Primary Examiner*—Michael A. Friedhofer
*Attorney, Agent, or Firm*—Paul J Sutton

[57] ABSTRACT

A rocker-type switch having components which can be assembled by automatic assembly machines and do not require the intervention of a human operator. A star shaped spring provides the necessary forces to hold the rocker in a selected position and hold the rocker to a switch spacer and couple the rocker to a movable contact arm. The movable contact arm is inserted in the switch spacer. The star spring is assembled to the rocker and the rocker is assembled to the movable contact arm when the rocker is assembled to the switch spacer.

14 Claims, 6 Drawing Sheets

ROCKER SWITCH USING A STAR SPRING

BACKGROUND OF THE INVENTION

1. Field of the Invention

The invention is directed to electrical rocker switches and more particularly to an electrical rocker switch which can be assembled by automatic equipment without human intervention.

2. Description of the Prior Art

FIGS. 1 to 5 show a rocker switch found in the prior art and FIGS. 1 to 4 are taken from U.S. Pat. No. 3,770,920 issued Nov. 6, 1973. FIG. 1 of the instant application is FIG. 1 of the patent, FIG. 2 is FIG. 8 of the patent, FIG. 3 is FIG. 8 of the patent and FIG. 4 is FIG. 6 of the patent. To assemble the pivoted rocker 24 to the brush 40 it is first necessary to place one end of coil spring 65 over the tab 64' and allow the last turn of spring 65 to fit under tab 64' and in contact with the base 64*a* of yoke-like opening 64. The spring 65 must next be rotated to place pigtail 65' perpendicular to the arms of brush 40 as shown in FIGS. 2 and 3. The assembled spring 65 and brush 40 must next be aligned with a slot 24*d* (see FIG. 5) in the boss 24*b* on the rocker 24 and the pigtail 65' pressed into slot 24*d* to assemble the spring 65 and the brush 40 to the rocker 24 (see FIG. 4). The need to snap the spring 65 over tab 64' and into the slot 24*d* of boss 24*b* and to align the pigtail 65' with slot 24*d* requires human intervention and prevents automatic assembly of the rocker 24 to the brush 40.

SUMMARY OF THE INVENTION

The instant invention overcomes the difficulties noted above with respect to the prior art by providing a rocker switch having a redesigned rocker, brush and spring which permits fully automatic assembly of the rocker to the brush and to the body of the rocker switch. A novel star shaped spring of the leaf-type is made up of flat spring stock and selectively bent to provide various functions. A V-notch receives the end of a movable contact arm and moves the arm between two positions as the rocker is operated. Two outwardly bent curved portions urge the V-shaped notch into contact with the movable contact arm and free the movable contact arm into contact with the arms connected to one line of an electrical circuit. The outwardly bent curved portions also urge the rocker upwardly and hold the trunnions of the rocker at the pivot ends of V-shaped recesses in the rocker switch body. Further, the spring has two inwardly curved portions to engage the rocker and hold the spring in assembly with the rocker prior to assembly to the rocker switch body. It is an object of the instant invention to provide a novel improved rocker switch.

It is an object of the instant invention to provide a novel rocker switch which can be assembled by automatic equipment.

It is another object of the instant invention to provide a novel rocker switch which eliminates the coil spring.

It is another object of the instant invention to provide a novel rocker switch which employs a leaf-type spring made up of flat spring stock.

It is yet another object of the instant invention to provide a novel rocker switch which employs a leaf-type spring made up of flat spring stock bent at various positions to provide necessary spring and control functions.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
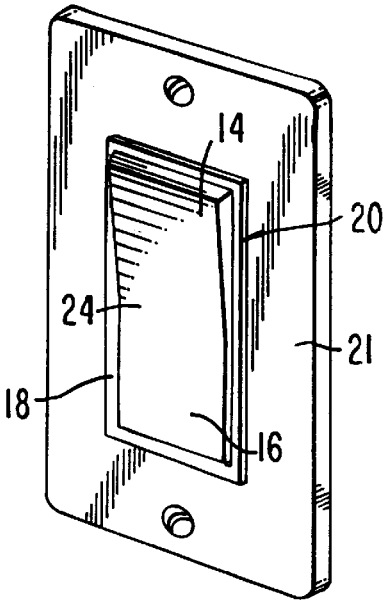
FIG. 1 PRIOR ART
FIG. 1 is a perspective view of an electrical wall switch and a wall plate and is FIG. 1 of the aforementioned U.S. Pat. No. 3,770,920.
Figure 3:
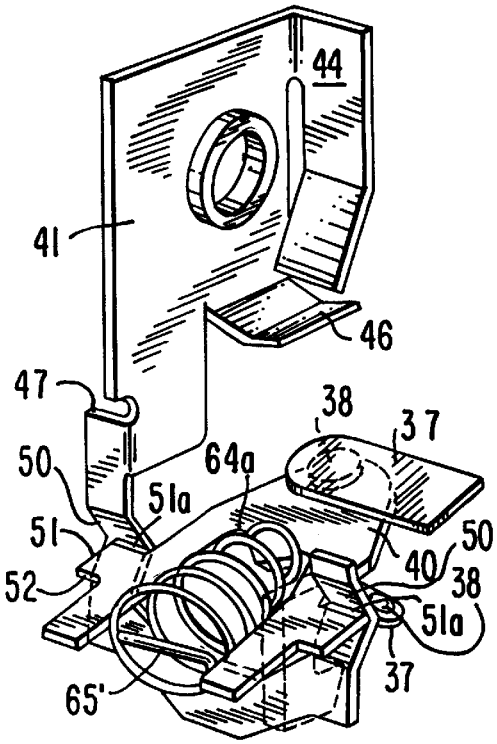
FIG. 3 PRIOR ART
FIG. 3 is an enlarged perspective view of the parts of the contact elements of FIG. 2 in their assembled condition and is FIG. 8 of the '920 patent.
Figure 2:
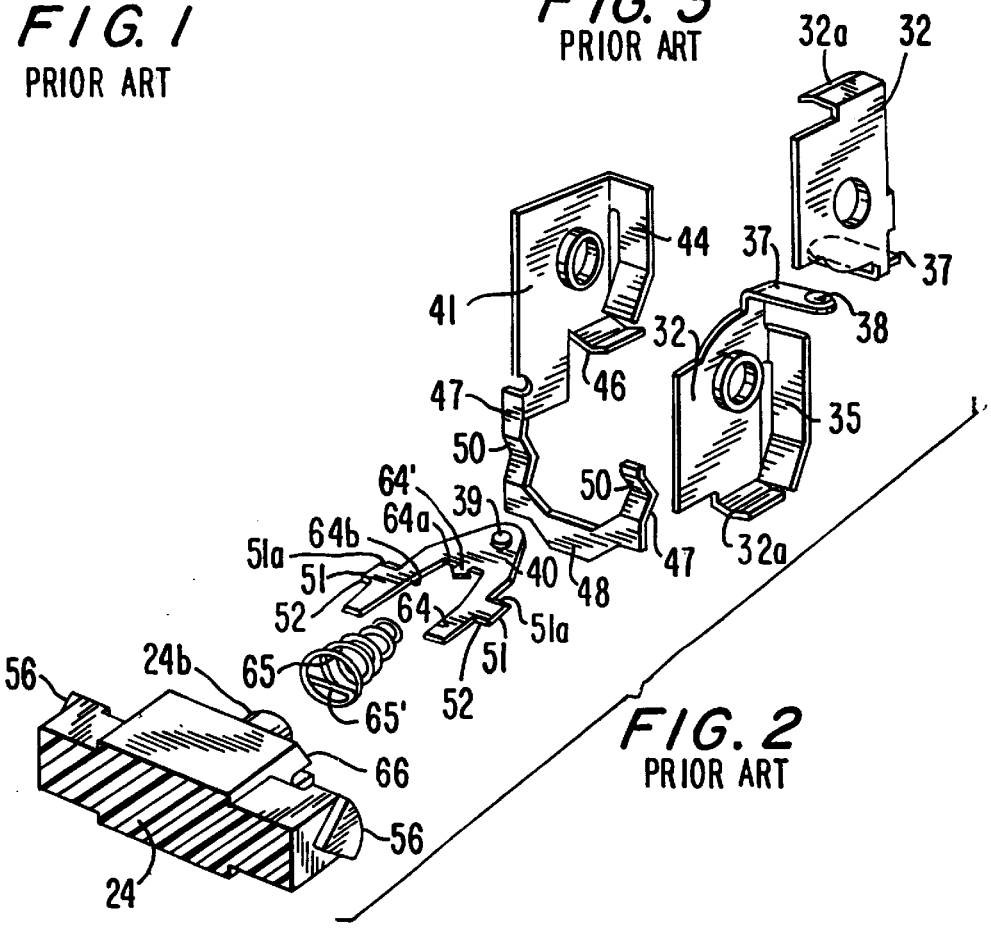
FIG. 2 PRIOR ART
FIG. 2 is an exploded perspective view of the contact elements and is FIG. 9 of the '920 patent.
Figure 4:
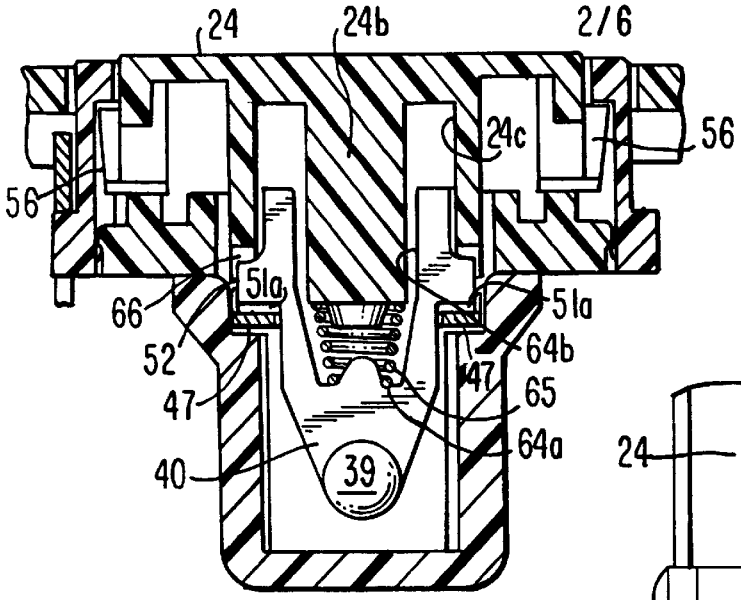
FIG. 4 PRIOR ART
FIG. 4 is an enlarged fragmentary view, in vertical section, taken along the transverse center line of the switch and is FIG. 6 of the '920 patent.
Figure 5:
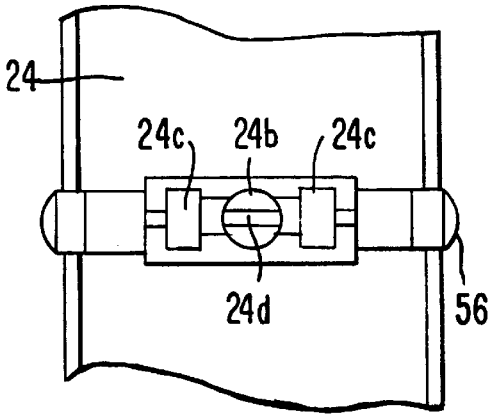
FIG. 5 PRIOR ART
FIG. 5 is a bottom view of the rocker of the switch and is based upon the '920 patent.

FIGS. 1 to 5 show the details of the basic rocker switch and FIGS. 1 to 4 are taken directly from U.S. Pat. No. 3,770,920 issued Nov. 6, 1973 for a "ROCKER-TYPE ELECTRICAL SWITCH" and the patent is incorporated herein by this reference the same as if the entire text were reproduced herein. FIG. 1 shows a switch 20 having a pivoted rocker 24 over which is placed a wall plate 21. The switch 20 is mounted to the mounting ears of a gem box (not shown) and the wall plate 21 is attached to and over the switch 20 with the rockers 24 extending through an opening 18 in wall plate 20 so that it can be operated by a user. The pivoted rocker 24 has a first panel 14 and a second panel 16 to control the state of the switch 20 depending upon which panel 14, 16 is depressed and the configuration of switch 20. If switch 20 has a single movable contact and a single fixed contact, depressing one panel will cause the movable contact to engage the fixed contact and close an electrical circuit. If the other panel is depressed the movable contact will be separated from the fixed contact and the electrical circuit will be opened. This is the typical on-off switch. In the event that switch 20 has two movable contacts and two fixed contacts, depressing one panel will cause a first movable contact to engage a first fixed contact and close a first electrical circuit while at the same time causing the second movable contact to separate from the second fixed contact to open a second electrical circuit. Depressing the other panel will cause the second movable contact to engage the second fixed contact to close the second electrical circuit and move the first movable contact away from the first fixed contact to open the first electrical circuit. Such an arrangement is called a single pole double throw switch.

Movable contact 39 and a similar one on the undersurface of brush 40 (not shown) are coupled to a line (not shown) which is common to two circuits via the arms 47 and the trunnions 51. The arms 47 are part of the common terminal plate 41 which is connected to a common line (not shown) via a threaded terminal screw 42 or by use of vertical inwardly bent portion 46 engaging the bared end of a conductor inserted through wire-receiving opening 45. In that the sharp edges 51*a* ride in the V-shaped notches in arms 47, there is continuous contact with the brush 40 and the brush 40 and contacts 39 are part of the common line. The fixed contact buttons 38 on contact carrying arms 37 are each connected to separate conductors of electric circuits by means of terminal plates 32. A conductor (not shown) can be attached to each of the terminal plates 32 using a threaded terminal screw or by inserting the bared end of a conductor through wire-receiving openings adjacent the wire locking tongue 35. The brush 40 is mounted between the contact carrying arms 37 and can close circuits between movable contacts 39 and one or the other of the two fixed contact buttons 38. (See FIGS. 2 and 3).

Figure 6:
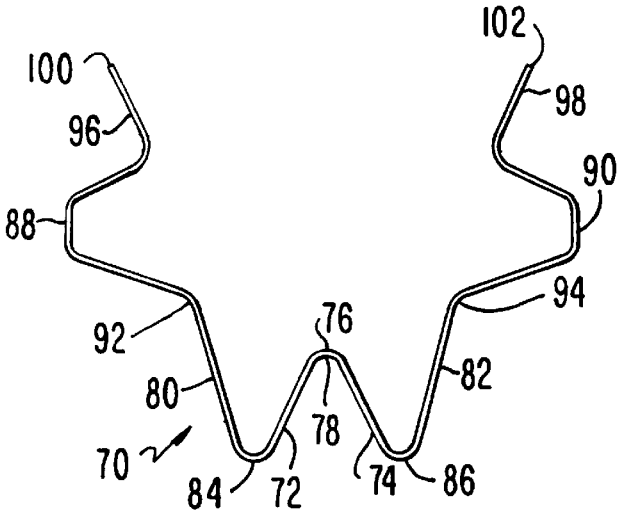
FIG. 6 is a side elevational view of the leaf-type spring element according to the instant invention.

Turning now to FIG. 6 there is shown a so-called "star spring" 70 which is placed between a movable contact arm and the switch rocker. Star spring 70 has a first pair of linear segments 72 and 74 which are joined at bend 76 to form a generally V-shaped notch 78 to receive one end of a movable contact arm. Each of the first linear segments 72 and 74 is connected to a second linear segment 80, 82 respectively at bends 84, 86 respectively. Linear segments 80 and 82 are each connected to an outwardly curved section 88, 90 respectively, at bends 92, 94, respectively. Each of the outwardly curved segments 88, 90 is coupled to an inwardly curved segment 96, 98, respectively, ending in a free end 100, 102, respectively. The inwardly curved segment 96, 98 will grip a wall on the rocker to be described below. The outwardly curved segments 88, 90 will flex as the rocker is moved to maintain forces on the rocker and the movable contact arm. The star spring is made of flat metal spring stock such as stainless steel and is bent so as to avoid sharp transitions or permanent bends.

Figure 7:
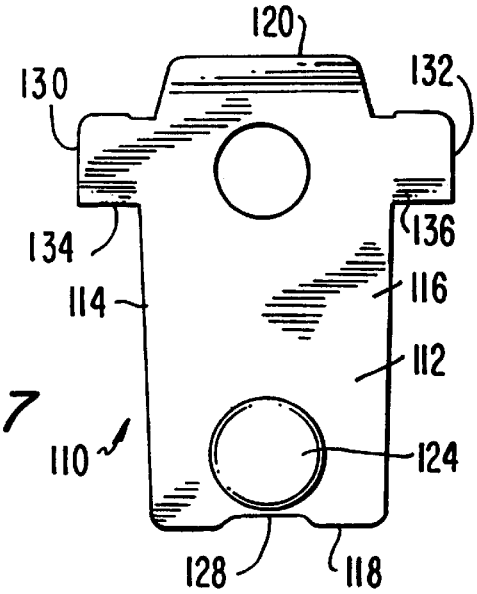
FIG. 7 is a front elevational view of the movable contact arm of the instant invention.
Figure 8:
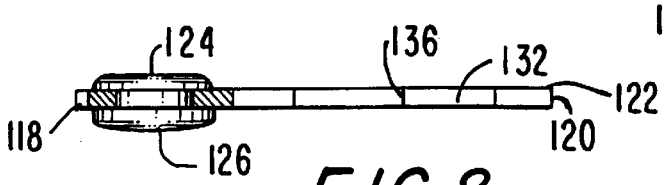
FIG. 8 is a side elevational view of the movable contact arm of FIG. 7.

The movable contact arm 110 (see FIGS. 7 and 8) has a generally rectangular body 112 extending between a pair of parallel, spaced apart side edges 114 and 116 and from a first end 118 to a second end 120. The second end 120 is tapered as at 122 to facilitate movement in the V-notch 78 of star spring 70. Contacts 124 and 126 are fixed to the body 112 adjacent first end 118. Two contacts 124, 126 are employed in a single pole double-throw switch and only one contact is used with the on-off switch. Only one contact would be placed on body 112 on the side facing the fixed contact button 38. A recess 128 is placed in first end 118. Two transversely extending ribs 130, 132 extend outwardly from side edges 114 and 116, respectively. The lower edges 134, 136 of transversely extending ribs 130, 132, respectively, are tapered to better ride in the V-notches 50 of the arms 47.

Figure 9:
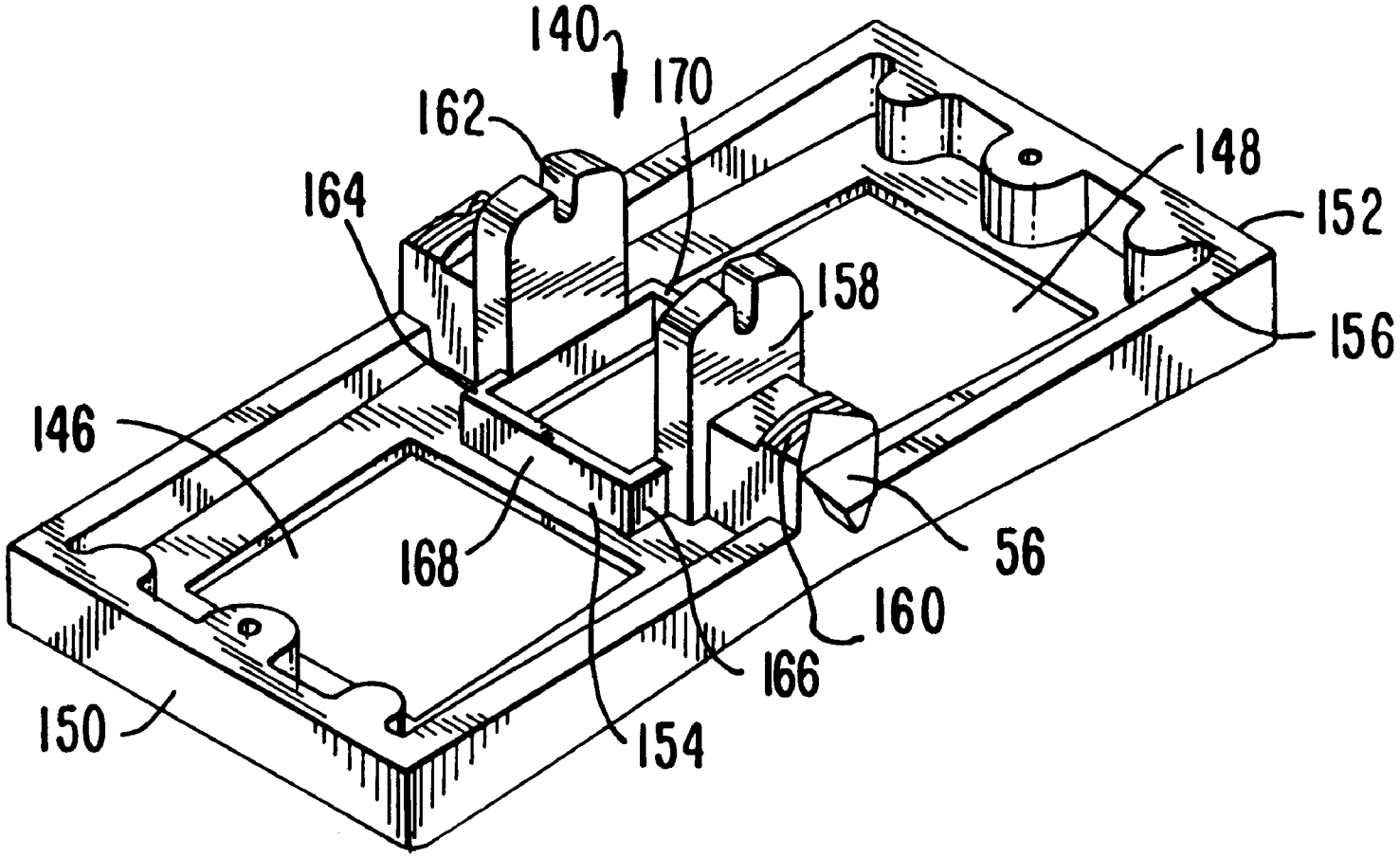
FIG. 9 is a perspective view of the underside of the rocker of the instant invention.
Figure 10:
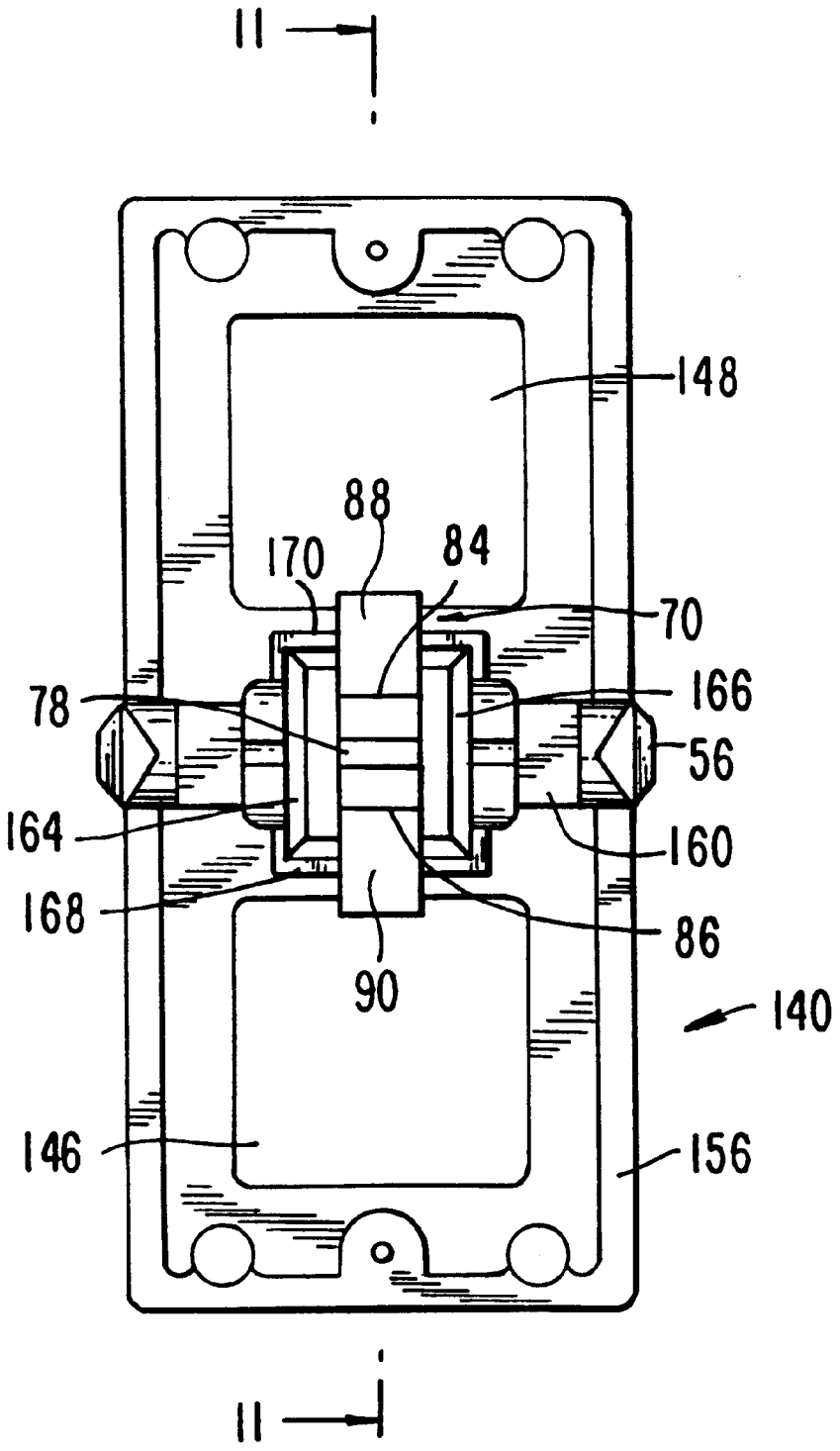
FIG.10 is a bottom plan view of the rocker of FIG. 9 with the spring of FIG. 6 installed thereon.
Figure 11:
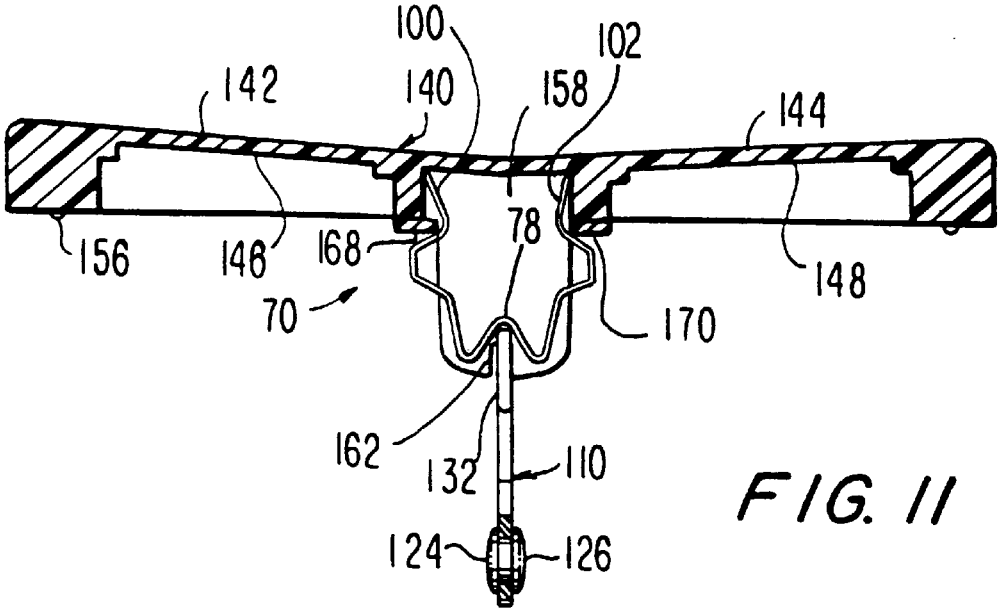
FIG. 11 is a sectional view of the rocker of FIG. 10 taken along the line 11—11 with the spring of FIG. 6 installed thereon and engaging the movable contact arm of FIG. 8 in a first position.

FIGS. 9 and 10 depict the rocker 140 having two panels 142, 144 the undersides 146, 148, respectively, of which are visible. The panels 142, 144 taper upwardly from the far ends 150, 152, respectively to the central hub 154 of rocker 140. A rib 156 extends about the entire periphery of rocker 140 and is coupled to trunnions 56 and to the trunnions 56 by blocks 160. Each of the support posts 158 has a slot 162 which extends inwardly from a free end. The slots 162 each receive one of the transversely extending ribs 130, 132. The slots 162 are wide enough to permit the movable contact arm 110 to pivot between two separate positions as will be set forth in greater detail below. When assembled the second end 120 of arm 110 will be in the V-notch 78 and depress the star spring 70 and portions of the transversely extending ribs 130, 132 will each be in one of the slots 162. The central hub 154 is made up a raised ridge in the form of a square. Two of the walls of the square 164, 166 extend in parallel with the longitudinal axis of the rocker 140 and are coupled to the support posts 158. The two remaining walls 168, 170 of the square are aligned with but offset from the transverse center line of the rocker 140. Each of the walls 168, 170 will be engaged by one of the two inwardly directed segments 96, 98 of star spring 70 to hold the star spring 70 in assembly with the rocker 140. FIG. 11 shows the position of the various components before any assembly forces are applied. The rocker 140 is shown in a neutral central position for ease of explanation and will not occur during actual practice. The rocker 140 is balanced between its two operating states, the star spring 70 is coupled to the walls 168, 170 at inwardly curved segments 96, 98. The second end 120 of the transversely extending rib 110 is in the V-notch 78 of star spring 70. The transversely extending ribs 130, 132 bottom surfaces have not entered the slots 162 of the support posts 158.

Figure 12:
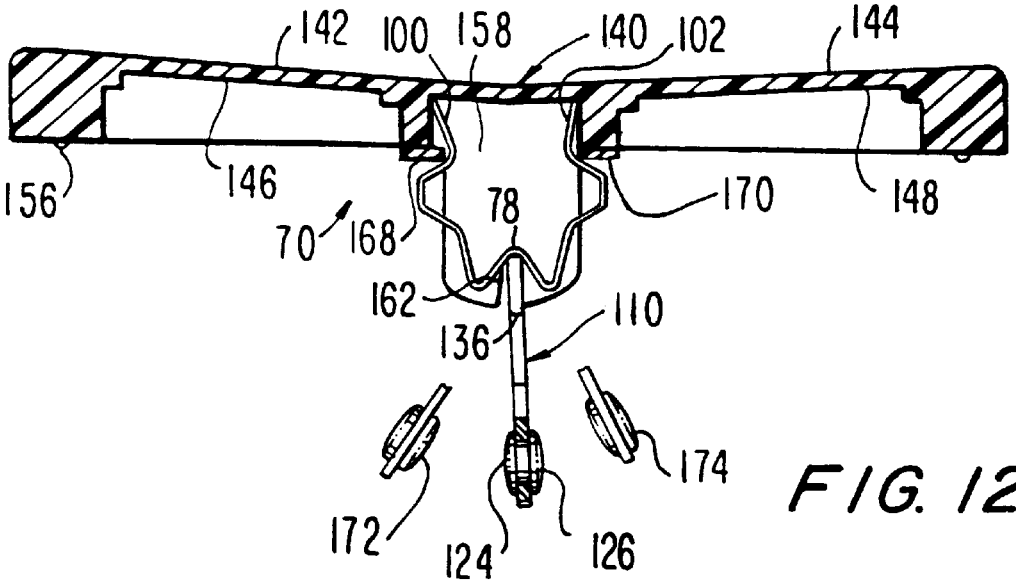
FIG. 12 is similar to FIG. 11 with the movable contact arm and spring in a second position.

When the rocker 140 is assembled to the spacer 55 by causing the engagement of the trunnions 56 with the apecies of the V-shaped notches 57 (see FIG. 2 of the '920 patent) and assuming that the movable contact arm 110 is still in the neutral position, the various components will appear as in FIG. 12. The transversely extending ribs 130, 132 of movable contact arm 110 are now fully in the slots 162 of the support posts 158. The lower edges 134, 136 (only one is visible in FIG. 12) extend beyond the support posts 158 to engage the V-notches 50 of the arms 47 (not shown). The force applied to the V-notch 78 of star spring 70 causes the second linear segments 80, 82 to flex outwardly away from each other and apply outwardly directed forces to the outwardly curved segments 88, 90 via the bends 92, 94 respectively. In turn the outwardly curved segments 88, 90 apply outwardly directed forces to the inwardly curved segments 96, 98 which separate the inwardly curved segments 96, 98 from the walls 168, 170. The ends 100, 102 are equally spaced from walls 168, 170. It should be recalled that this condition does not occur in the rocker switch of the invention and is included to better describe the fine tuning of the rocker switch. The movable contacts 124, 126 are in a central position and do not engage fixed contact buttons 172, 174 respectively.

Figure 13:
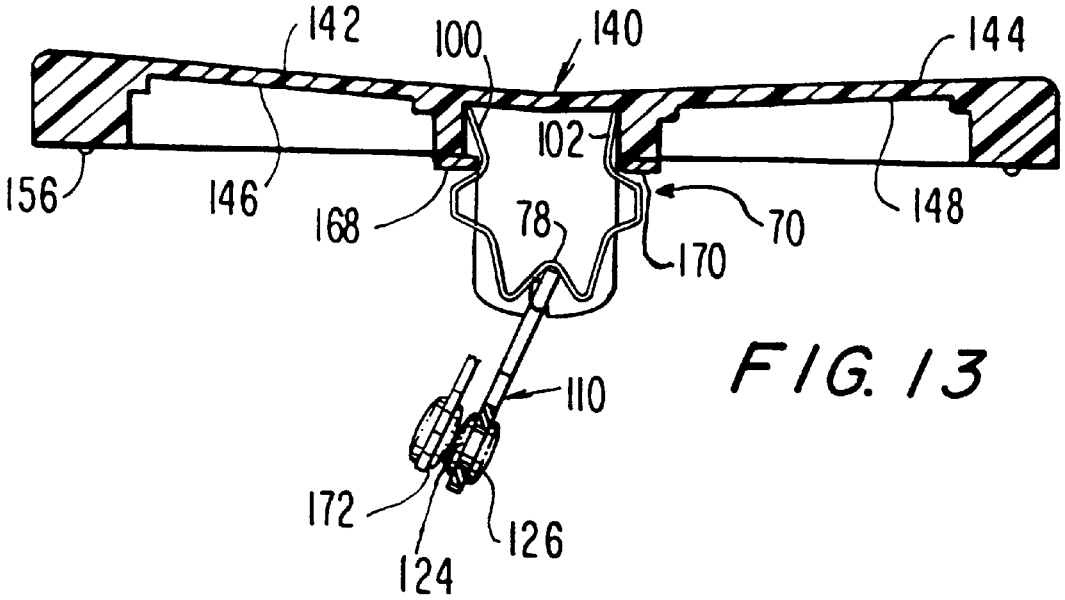
FIG. 13 is similar to FIG. 11 but shows the positions of the spring and movable contact arm when the left panel of the rocker is depressed.

When the rocker 140 is rotated counter-clockwise about the V-shaped notches 57 (not shown) by a user engaging panel 142 the various components take the positions shown in FIG. 13. The movable contact arm 110 is moved in a clockwise direction towards the underside 146 of panel 142. The V-notch 78 of star spring 70 is forced to the right in FIG. 13 and the inwardly curved segment 98 of star spring 70 moves away from wall 170. Inwardly curved segment 96 remains in contact with wall 168. This causes the segments 82, 90, 98 to apply a spring force on the movable contact arm 110 to hold it in the overcenter position. Movable contact 124 engages fixed contact button 172.

Figure 14:
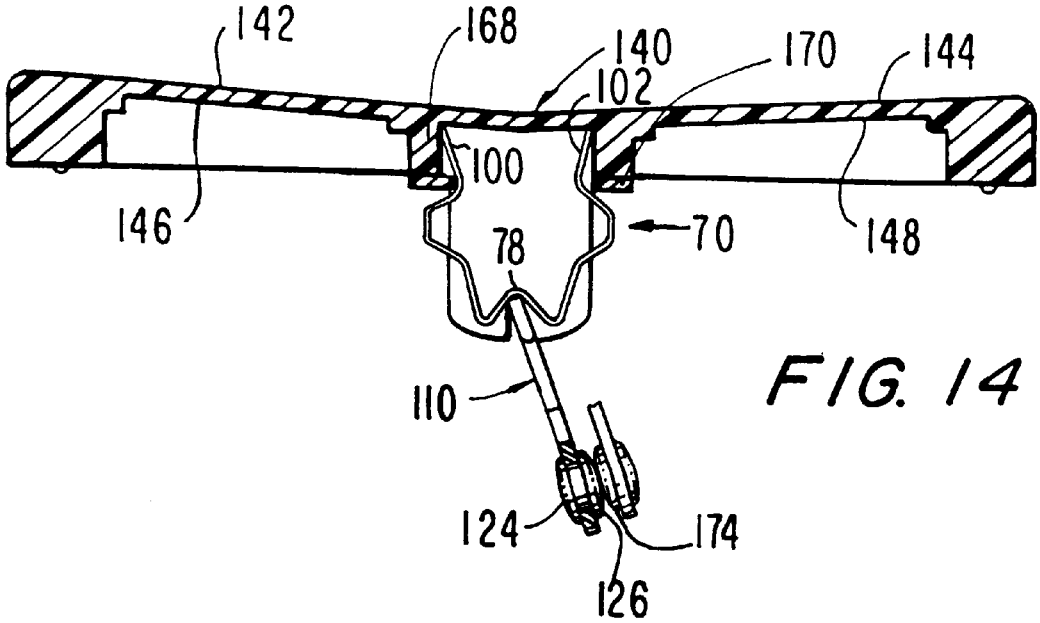
FIG. 14 is similar to FIG. 11 but shows the positions of the spring and movable contact arm when the right panel of the rocker is depressed.

FIG. 14 shows the position of the components of the switch when the rocker 140 has been moved in a clockwise fashion about the V-shaped notches 57 (not shown) by a user depressing the panel 144. The movable contact arm 110 has moved in a counter-clockwise direction toward the underside 148 of panel 144. The V-notch 78 of star spring 70 is forced to the left in FIG. 14 and the inwardly curved segment 96 is moved away from wall 168. Inwardly curved segment 98 remains in contact with wall 170. The force of the star spring 70 upon the movable contact arm 110 holds it in its second overcenter position. Movable contact 126 engages fixed contact button 174. The FIGS. 12 to 14 show the arrangement for a single pole double-throw switch. For a simple on-off switch one of the movable contacts 124, 126, respectively, will be omitted and the associated fixed contact button 172, 174, respectively, will also be omitted.

To assemble the switch, the base assembly 26 is made according to the '920 patent. Spacer 55 and base 28 are snapped or otherwise fastened together. A central aperture 63 in the spacer 55 provides access to the arms 47 and their V-shaped notches 50. The movable contact arm 140 is inserted through central aperture 63 so that the lower edges 134, 136 of the transversely extending ribs 130, 132, respectively each engage one of the V-shaped notches 50. Next the star spring 70 is positioned on the rocker 140 between the support posts 58 with inwardly curved segment 96 engaging wall 168 and inwardly curved segment 98 engaging wall 170. The rocker 140 is now positioned over spacer 55 and pushed downwardly towards spacer 55 until the trunnions 56 enter the notches 57 holding the rocker 140 in place within the spacer 55 and the V-notch 78 in engagement with the second end 120 of the movable contact arm 110. The wide second end 120 and the wide star spring 70 allow the assembly of the star spring 70 and arm 110 over a wide range and do not require the precision required for the assembly of the switch of the '920 patent.

While there have been shown and described and pointed out the fundamental novel features of the invention as applied to the preferred embodiment, as is presently contemplated for carrying them out, it will be understood that various omissions and substitutions and changes of the form and details of the device illustrated and in its operation may be made by those skilled in the art, without departing from the spirit of the invention.

We claim:

1. In an electrical rocker switch, the improvement comprising:

a) a movable contact arm having a body extending from a first end to a second end and between two, spaced apart, parallel side edges, said movable contact arm having two transversely extending ribs, each of said two transversely extending ribs extending from a different one of said side edges adjacent said second end and aligned with one another, said movable contact arm placeable in one of a first and second position;

b) at least one movable contact on said movable contact arm adjacent said first end and adapted to engage a fixed contact to complete a first electrical circuit when said movable contact arm is in said first position;

c) a rocker comprising, on a first side, two panels, each of said panels engagable by a user to place said movable contact arm in one of said two positions, and on a second side a pair of support posts extending outwardly, generally perpendicular to said second side of said rocker, said support posts having slots therein from a free end towards said second side of said rocker, each of said slots receiving one of said transversely extending ribs to permit said movable contact arm to pivot about said support posts to move between said first and second positions; and d) a leaf-type spring member composed of flat spring stock selectively bent to provide a plurality of segments to engage said movable contact arm at said second end and said second side of said rocker to position said movable contact arm in one of said two positions based upon which one of said two panels is depressed by said user.

2. An electrical rocker switch, as defined in claim 1, wherein said spring member has two first linear segments jointed to form a V to receive said movable contact arm at said second end.

3. An electrical rocker switch, as defined in claim 2, wherein said spring member has two outwardly curved segments coupled to said two first linear segments to urge said second end of said movable contact arm away from said second side of said rocker.

4. An electrical rocker switch, as defined in claim 3, wherein each of said two outwardly curved segments are coupled to an associated one of said two first linear segments by one of two second linear segments.

5. An electrical rocker switch, as defined in claim 3, further comprising:

a) two parallel, spaced apart walls on said rocker second side between said pair of support posts and extending away from said rocker second side; and b) two inwardly curved segments, each inwardly curved segment coupled to one of said two outwardly curved segments and a apex of each of said two inwardly curved segments engaging an associated one of said two walls to assemble said spring member to said rocker.

6. An electrical rocker switch, as defined in claim 5, wherein each of said spring member two inwardly curved segments terminate in a free end which engages said rocker second side.

7. An electrical rocker switch, as defined in claim 1, wherein said at least one movable contact on said movable contact arm is two movable contacts, a first of the movable contacts engageable with a first fixed contact to complete a first electrical circuit when said movable contact arm is in said first position, a second of the movable contacts engageable with a second fixed contact to complete a second electrical circuit when said movable contact arm is in said second position.

8. An electrical rocker switch, as defined in claim 7, wherein said spring member has two first linear segments joined to form a V to receive said movable contact arm at said second end.

9. An electrical rocker switch, as defined in claim 8, wherein said spring member has two outwardly curved segments coupled to said two first linear segments to urge said second end of said movable contact arm away from said second side of said rocker.

10. An electrical rocker switch, as defined in claim 9, wherein each of said two outwardly curved segments are coupled to an associated one of said two first linear segments by one of two second linear segments.

11. An electrical rocker switch, as defined in claim 9, further comprising:

a) two parallel, spaced apart walls on said rocker second side between said pair of support posts and extending away from said rocker second side; and b) two inwardly curved segments, each inwardly curved segment coupled to one of said two outwardly curved segments and a apex of each of said two inwardly curved segments engaging an associated one of said two walls to assemble said spring member to said rocker.

12. An electrical rocker switch, as defined in claim 11, wherein each of said spring member two inwardly curved segments terminate in a free end which engages said rocker second surface.

13. An electrical rocker switch, as defined in claim 1, wherein said at least one movable contact is out of contact with a fixed contact to open said first electrical circuit when said movable contact arm is in said second position.

14. A method of coupling a rocker member to a movable contact arm in a body position of a rocker switch having a pair of flat, spaced arms, comprising the steps of:

a) inserting a movable contact arm into said body portion to engage said pair of flat, spaced arms;

b) placing a leaf-type spring member composed of flat spring stock bent to provide a plurality of segments on an inner surface of the rocker member with a V-shaped notch facing away from said inner surface of the rocker member;

c) aligning said V-shaped notch with said movable contact arm; and d) joining said rocker member to said body portion of said rocker switch.

* * * * *